US006557262B1

(12) United States Patent
Clemence et al.

(10) Patent No.: US 6,557,262 B1
(45) Date of Patent: May 6, 2003

(54) CUTTING APPARATUS HAVING A PIVOTABLE BLADE HOLDER

(75) Inventors: Richard M. Clemence, Southbridge, MA (US); Richard M. Farland, Southbridge, MA (US); Eric Wilhelm, Marlborough, MA (US)

(73) Assignee: Hyde Manufacturing Company, Southbridge, MA (US)

( * ) Notice: Subject to any disclaimer, the term of this patent is extended or adjusted under 35 U.S.C. 154(b) by 139 days.

(21) Appl. No.: 09/771,080

(22) Filed: Jan. 27, 2001

(51) Int. Cl.[7] ..... B26B 1/02
(52) U.S. Cl. ..... 30/156; 30/2; 30/293
(58) Field of Search ..... 30/2, 155, 156, 30/293, 294, 331

(56) References Cited

U.S. PATENT DOCUMENTS

| | | | | |
|---|---|---|---|---|
| 2,018,149 A | | 10/1935 | Randle et al. | |
| 2,597,540 A | | 5/1952 | Smith | |
| 3,641,667 A | * | 2/1972 | Leopoldi | 30/2 |
| 4,501,069 A | | 2/1985 | Kohno | |
| 5,203,086 A | | 4/1993 | Dann | |
| 5,881,463 A | | 3/1999 | Casteel et al. | |
| 5,943,780 A | | 8/1999 | McIlhatten | |

* cited by examiner

*Primary Examiner*—Douglas D. Watts
(74) *Attorney, Agent, or Firm*—Louis J. Franco

(57) ABSTRACT

A cutting apparatus having a pivotable blade holder includes a blade housing with an internal blade cavity with a blade opening to the outside of the housing. A blade holder adapted for removably retaining a cutting blade having a cutting edge is pivotally mounted within the housing for pivotal movement about a lateral pivot axis between a fully retracted position and a cutting position. The fully retracted position is such that the cutting edge of a cutting blade retained by the blade holder does not protrude through the blade opening to the outside of the blade housing. A cutting position is one in which the cutting edge of the cutting blade extends through the blade opening to the outside of the housing. A blade actuator accessible to a user from the exterior of the housing, when depressed, urges the blade holder into a cutting position while a biasing member normally biases the blade holder toward its fully retracted position. A depth adjuster controls the maximum angle by which the blade holder can be pivotally displaced from the fully retracted position in order to control the depth to which the cutting blade can cut a material.

16 Claims, 6 Drawing Sheets

CUTTING APPARATUS HAVING A PIVOTABLE BLADE HOLDER

FIELD

This invention relates generally to cutting apparatus and, in one or more aspects, a cutting apparatus that is particularly well suited for the cutting of wallpaper.

BACKGROUND

Cutting apparatus including adjustably extendable blades are known. One common example is a utility knife. A typical utility knife includes a housing with a blade opening in the front end thereof and a blade holder that linearly reciprocates within the housing for alternate extension and retraction of a cutting blade through the blade opening. Moreover, the blade holder of a utility knife is generally selectively lockable into various locking positions corresponding to different distances by which the blade extends from the housing. The linear movement of the blade holder is enabled by a linearly reciprocable button connected to the blade holder and accessible to a user from the exterior of the housing. Once the blade is locked into an extended position, manual intervention is typically required in order to move the blade back into the housing. Additionally, it is difficult, if at all possible, to alternately extend and retract the blade while the knife is being grasped for cutting; adjustment of one's grasp is generally necessary in order to withdraw the blade into the blade housing.

One prior hand-held cutting tool described in U.S. Pat. No. 2,018,149 includes a holder with a blade carrier mounted for angular movement within the holder. An adjusting screw is connected to the blade carrier and cooperates with a thrust nut mounted on the screw. The angle of the blade carrier with respect to the holder is adjusted by turning the adjusting nut.

SUMMARY

Various embodiments and versions of a cutting apparatus may include one or more of the following features.

In one embodiment, a cutting apparatus having a pivotable blade holder (hereinafter "cutting apparatus") includes a blade housing having an internal blade cavity with a blade opening to the outside of the housing. The blade housing extends longitudinally between rear and forward ends and includes right and left sides and upper and lower surfaces. Pivotally mounted within the housing is a blade holder that is pivotable about a lateral axis passing through the left and right sides. The blade holder is pivotable between a fully retracted position in which the cutting edge of a cutting blade retained thereby is contained within the housing such that the cutting edge does not protrude through the blade opening to the outside of the housing and a second, cutting position in which the cutting edge of the blade at least partially protrudes through the blade opening to the outside of the housing.

Another version of a cutting apparatus having a pivotable blade holder includes a biasing member that normally biases the blade holder toward the fully retracted position and a blade actuator accessible from the outside of the housing, and cooperating with the blade holder, such that application of an external force by a user to the blade actuator moves the blade holder toward a cutting position in opposition to the biasing force of the biasing element. When the external force is removed from the blade actuator, the biasing element returns the blade holder toward the fully retracted position. The biasing member can be, for example, a torsion spring, leaf spring, coiled spring, elastic member or other resilient member. In one variation, the upper surface of the blade housing includes an actuator slot in communication with the blade cavity and the blade actuator depends from the blade holder and extends upwardly through the actuator slot where it is accessible to a user. The blade actuator includes an upper side that extends at least partially forward of the pivot axis such that a downwardly directed force (i.e., generally toward the lower surface of the blade housing) applied forward of the pivot axis to the upper side of the blade actuator urges the blade actuator toward a cutting position.

In another version, the lower surface of the blade housing defines a guide surface including at least a portion of the blade opening and along which the cutting apparatus is drawn over a material to be cut. The cutting position is such that the cutting edge of the blade inclines rearwardly with respect to the guiding surface so that, when the cutting apparatus is drawn rearwardly with the guiding surface in contact with the material to be cut, the cutting edge advances through the material at an acute angle.

In another embodiment, the maximum depth to which the blade can cut into a material is adjustable. More specifically, the maximum angle by which the blade holder can be pivotably displaced along an arc of an imaginary circle from the fully retracted position is adjustable. In one version, the cutting apparatus includes a depth adjuster that is selectively lockable into at least two locking positions, each of which locking positions corresponds to a different maximum angle by which the blade holder can be displaced with respect to the fully retracted position. In one variation, the housing includes an elongated track having fore and aft ends. The track extends longitudinally between the rear and forward ends of the housing along an imaginary chord of the imaginary circle. A depth adjuster is mounted for linear reciprocation between the aft and fore ends of the track. The depth adjuster includes a button accessible to a user from the exterior of the housing and a blade-holder bearing surface movable in tandem with the button and against which an arresting surface of the blade holder bears when the blade holder is maximally displaced from the fully retracted position. The depth adjuster is selectively lockable into at least two locking positions, each locking position corresponding to a different longitudinal position of the blade-holder-bearing surface. The blade-holder bearing surface is movable within the angular path of the blade holder such that a first locking position allows the blade holder to be displaced by a first maximum angle from its fully retracted position before the blade holder is arrested by the blade-holder bearing surface, and a second locking position allows the blade holder to be displaced by a second maximum angle before the blade holder is arrested by the blade-holder bearing surface. In one version, one locking position corresponds to a "safety" position in which the blade holder cannot be pivoted to an extent that would cause the cutting edge of a blade retained thereby to protrude out of the housing. Alternatively, a separate locking member can be included, independent of the depth adjuster.

In another version of a cutting apparatus including a depth adjuster, the blade holder includes an arresting surface that extends forward of the pivot axis. The arresting surface is positioned and adapted for alternative contacting engagement and disengagement with the blade-holder bearing surface. Furthermore, the blade-holder bearing surface reciprocates along a linear path below the arresting surface and the arresting surface inclines rearwardly toward the pivot axis with respect to the reciprocation path of the blade-holder bearing surface such that more rearward positions of the blade-holder bearing surface correspond to greater maximum pivotal displacement angles of the blade holder than do more forward positions of the blade-holder bearing surface.

Although the scope and spirit of the invention are in no way limited by blade size or configuration, embodiments and versions adapted to house and retain standard rectangular razor blades are advantageous. Among the advantages of such embodiments are that standard rectangular razor blades are readily available and embodiments adapted to retain them can be compact.

In another version, the actuator slot extends longitudinally forward of the pivot axis in the upper surface of the blade housing, and is sufficiently elongated and wide, to enable the blade holder to pivot upwardly and protrude out of the blade housing into a position that enables removal and replacement of a cutting blade (i.e., a blade changing position). To prevent inadvertent pivoting of the of the blade holder into a blade changing position, one variation includes a blade-changing lock. The blade-changing lock includes a first lock element carried by the blade housing and a second lock element carried by the blade holder. The first and second lock elements are selectively moveable into locked and unlocked positions with one another. When the first and second lock elements are in a locked position, pivotal movement of the blade holder with respect to the blade housing is restricted between the fully retracted position and a cutting position. When the first and second lock elements are in an unlocked position, the blade holder can pivot upwardly into a blade changing position.

An advantage of a cutting apparatus including a housing and a pivotably mounted blade holder in which the maximum angular displacement is adjustable is that the cutting apparatus can be used to cut through materials of different thicknesses without cutting too deeply into a supporting surface under the material to be cut. This feature may prove particularly useful in the cutting and trimming of wallpaper, for example.

A version of a cutting apparatus having a pivotable blade holder and including a blade actuator in which downward depression thereof (i.e., generally toward a material to be cut) by a user's finger causes the cutting edge of the blade to protrude from the housing is particularly well-suited for fine trimming work, such as the trimming of wallpaper. An advantage of such a cutting apparatus is that the force applied to extend the blade contributes to proper and natural grasping and control of the cutting apparatus while making cuts. As will be more fully appreciated upon examination of the detailed description and drawings, a user grasps such a version by applying opposed forces on either side of the blade housing with the thumb and side of the middle finger, while the index finger is positioned over the blade actuator. When a cut is to be made, the user depresses the blade actuator to extend the blade, places the cutting edge in contact with the material to be cut and pushes with the index finger into the material while drawing the cutting apparatus rearward. A further advantage is realized by including a biasing element that normally biases the blade holder toward the fully retracted position; once the user withdraws the blade from the material, he or she simply removes the force provided by his or her index finger and the blade withdraws into the housing.

Another advantage is provided by a version in which the blade holder can be pivoted into a blade changing position through the upper surface of the blade housing; unlike a utility knife, there is no need to disassemble the blade housing in order to change or reverse the blade.

Other features, aspects and advantages of a cutting apparatus having a pivotable blade holder are revealed in the following detailed description and the accompanying drawings of illustrative embodiments.

DETAILED DESCRIPTION

Figure 1:
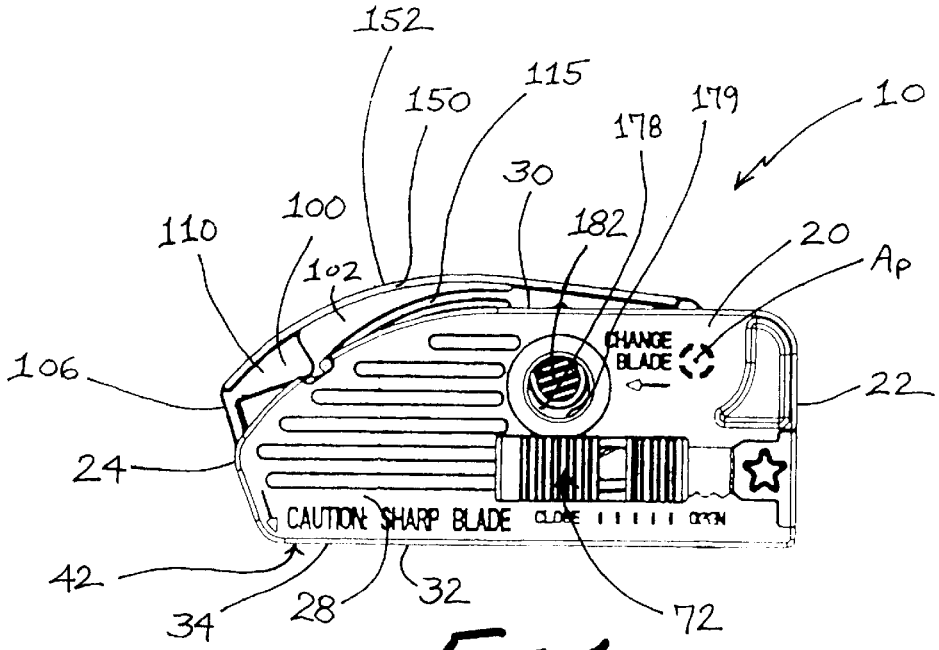
FIG. 1 is a left side view of a cutting apparatus having a pivotable blade holder.
Figure 2:
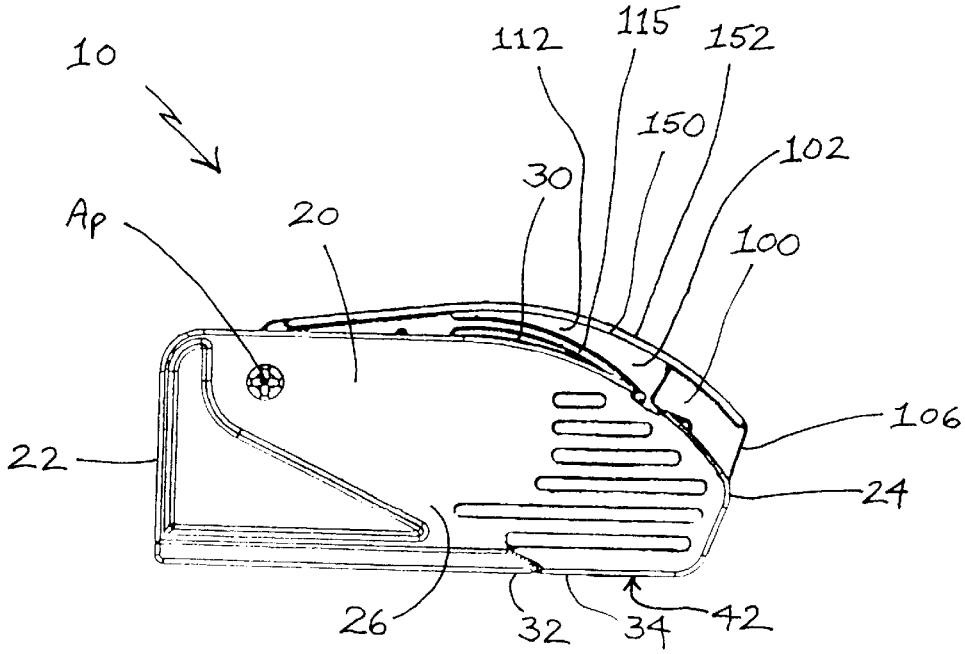
FIG. 2 is a right side view of a cutting apparatus having a pivotable blade holder.
Figure 3:
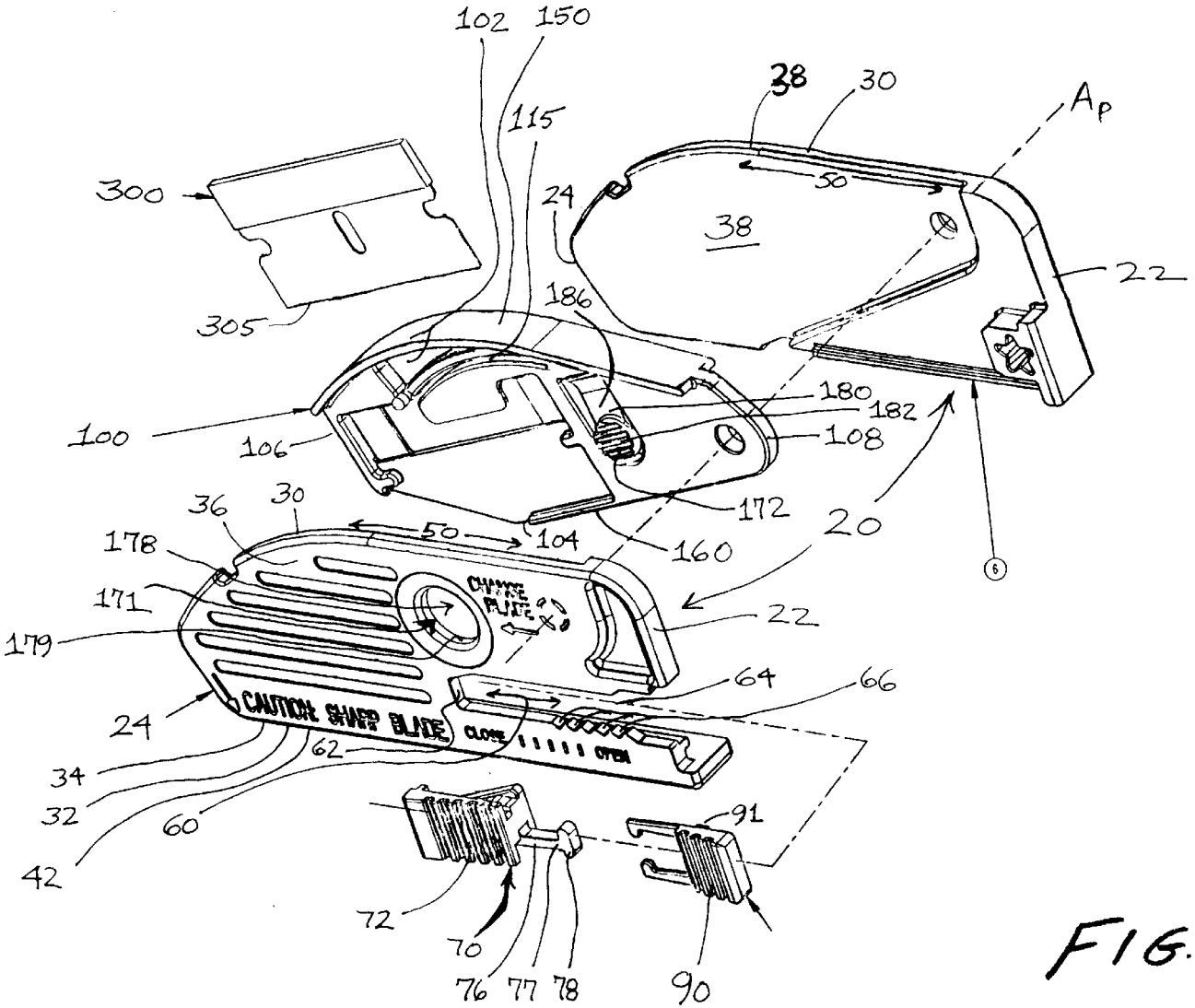
FIG. 3 is a left-rear exploded view of a cutting apparatus having a pivotable blade holder.

The following description of a cutting apparatus is demonstrative in nature and is not intended to limit the invention or its application of uses. The invention is susceptible to various modifications and alternative forms and certain specific embodiments and versions thereof are illustrated by way of example in the drawings and are herein described in detail. It should be understood, however, that the descriptions and illustrations of specific embodiments herein are not intended to limit the invention to the particular forms disclosed; on the contrary, the intention is to cover all modifications, equivalents, and alternatives encompassed by the spirit and scope of the invention as defined by the appended claims.

Referring to FIGS. 1 to 7, a cutting apparatus 10 includes a blade housing 20 that extends longitudinally between a rear end 22 and a forward end 24, and includes a right side 26, a left side 28, an upper surface 30 and a lower surface 32. The lower surface 32 includes a guiding surface 34 along which the cutting apparatus 10 can be drawn across a material (not shown) to be cut. In the illustrative versions of the drawings, the housing 20 is comprised of left and right side housing members 36 and 38 that, in alternative versions, are permanently or separably joined to one another. The left and right side housing members 36 and 38 can be permanently joined, on the one hand, by press fitting, ultrasonic welding, one or more rivets and or adhesive, for example, and separably joined, on the other hand, by one or more threaded fasteners or snap-fitting elements, by way of example.

The housing 20 further includes an internal blade cavity 40 including a blade opening 42 open to the exterior of the housing 20. In the versions illustrated, the blade opening 42 extends through at least a portion of the guiding surface 34 to the outside of the housing 20.

Pivotally mounted within the housing 20 is a blade holder 100 that is pivotable about a lateral pivot axis $A_P$. The blade holder 100 is adapted for removably retaining a cutting blade 300 having a cutting edge 305 and includes a top 102, a bottom 104, front and back ends 106 and 108 and left and a right sides 110 and 112. The blade holder 100 is pivotable between a fully retracted position, in which the cutting edge 305 is contained within the housing 20, and a cutting position, in which the cutting edge 305 at least partially protrudes from the housing 20 through the blade opening 42. In the versions shown, the pivot axis $A_P$ is adjacent the back end 108 of the blade holder 100 and a biasing element 115 normally biases the blade holder 100 toward its fully retracted position.

Referring to FIGS. 1–4, a blade actuator 150 accessible from the exterior of the housing 20 cooperates with the blade holder 100 such that, when a user applies a force to the blade actuator 150, in opposition to the force exerted by the biasing element 115, the blade holder 100 is angularly displaced toward a cutting position. In the specific version illustrated, the blade actuator 150 depends from the blade holder 100. Furthermore, the upper surface 30 of the housing 20 defines an elongated actuator slot 50 leading to the blade cavity 40 through which a portion of the blade holder 100 protrudes. See FIGS. 3 and 4. Atop the protruding portion of the blade holder 100 is the blade actuator 150. The blade actuator 150 extends laterally such that the protruding portion of the blade holder 100 is generally T-shaped as viewed into a plane perpendicular to the longitudinal axis of the housing 20. In addition, the blade actuator 150 is curved downwardly toward the front end 106 of the blade holder 100 and extends longitudinally over most of length of the blade holder 100 to define an upper side 152 that is adapted to comfortably support a substantial portion of a user's index finger when grasped and used as intended. The upper side 152 extends at least partially forward of the pivot axis $A_P$ such that a downwardly directed force applied forward of the pivot axis $A_P$ to the upper side 152 of the blade actuator 150 urges the blade holder 100 toward a cutting position. By involving more than just the tip of the index finger in depressing the blade actuator 150 during use, cuts can be made for substantial lengths of time without the user's enduring fatigue. Furthermore, enhanced control of the cutting apparatus 10 is realized.

Figure 5:
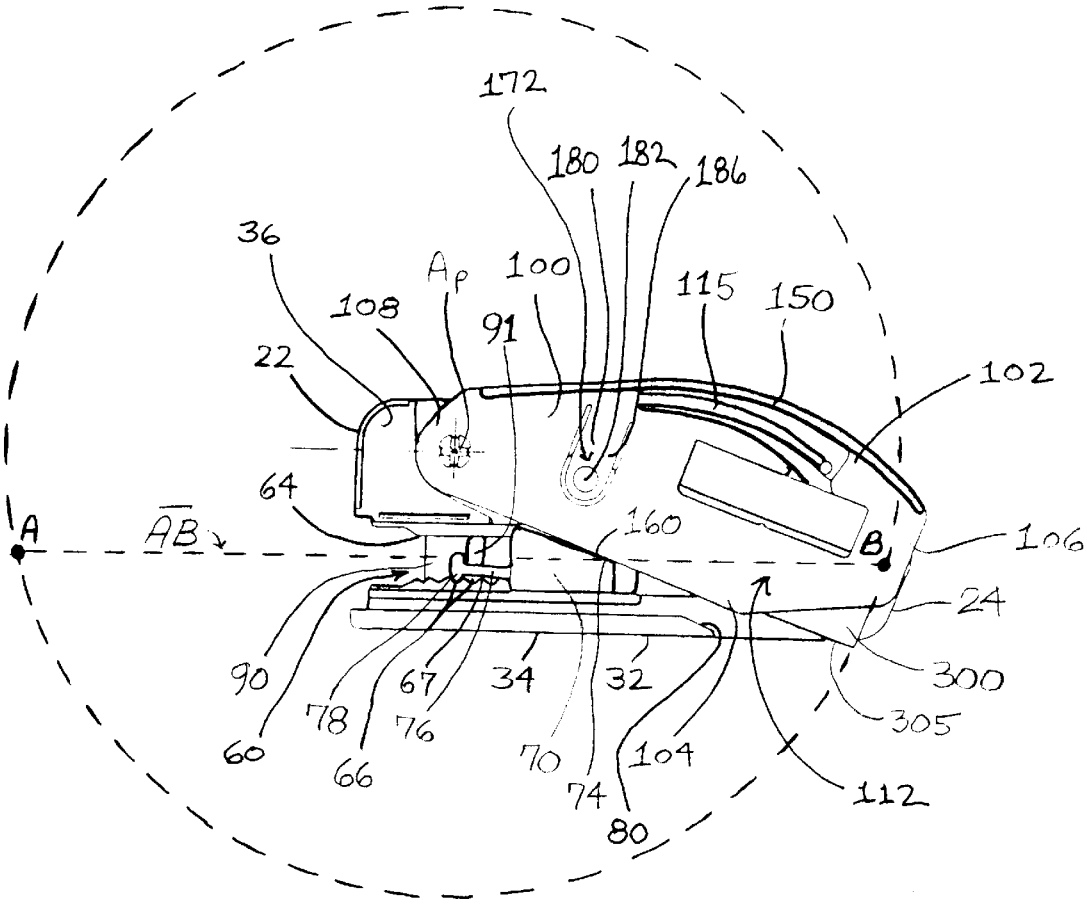
FIG. 5 is a right side view of a cutting apparatus with a blade holder pivotally mounted to a left side housing member of a blade housing and an imaginary circle in phantom centered at the pivot axis of the blade holder.

In one version, the maximum depth to which the cutting edge 305 of the cutting blade 300 can cut into a material is adjustable. More specifically, the maximum angle $\theta$ by which the blade holder 100 can be displaced from the fully retracted position along an arc of an imaginary circle centered at the pivot axis $A_P$ is selectively restrictable. See FIG. 5 in which an imaginary circle centered at the pivot axis $A_P$ is shown in phantom. The housing 20 includes an elongated track 60 having fore and aft ends 62 and 64. The track 60 extends longitudinally between the rear and forward ends 22 and 24 of the housing 20. A depth adjuster 70 is mounted for linear reciprocation between the fore and aft ends 62 and 64 of the track 60. Furthermore, as shown in FIG. 5, the depth adjuster 70 is reciprocable substantially along a chord AB of the imaginary circle. The depth adjuster 70 includes a button 72 accessible to a user from the exterior of the housing 20 and a laterally extending blade-holder bearing surface 74 against which an arresting surface 160 of the blade-holder 100 bears when the blade holder 100 is maximally displaced from the fully retracted position into a cutting position. That is, "maximally displaced" with respect to a particular longitudinal position of the depth adjuster 70.

Figure 6A:
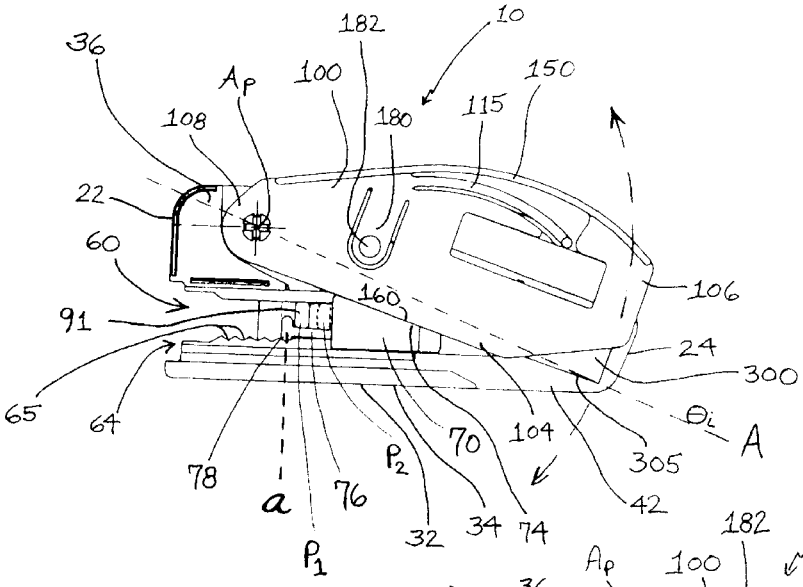
FIG. 6A shows the cutting apparatus of FIG. 5 with the blade holder in a fully retracted position.
Figure 6B:
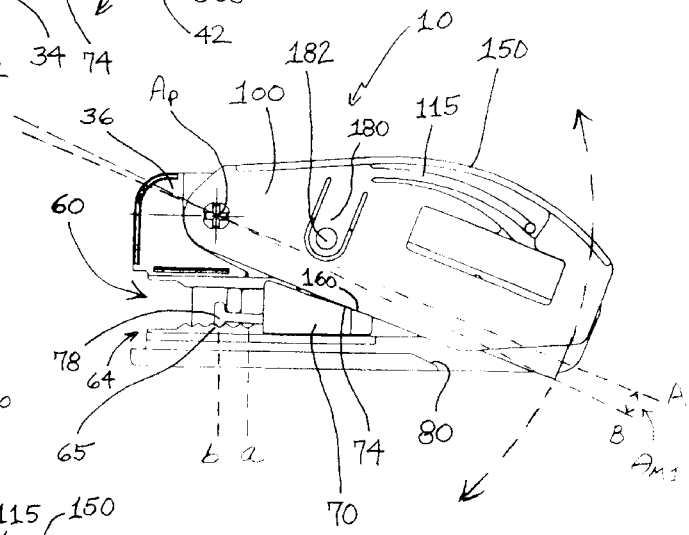
FIG. 6B shows the cutting apparatus of FIGS. 5 and 6A with the blade holder angularly displaced by a first angle with respect to the position of FIG. 6A into a second angular position.
Figure 6C:
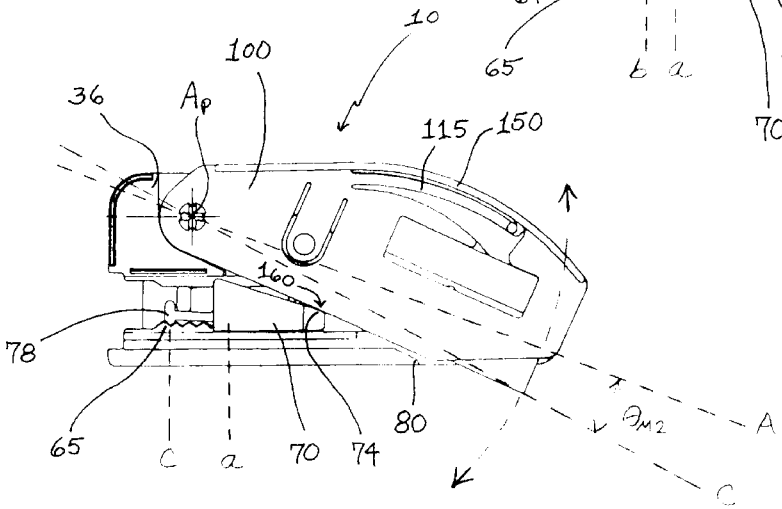
FIG. 6C shows the cutting apparatus of FIGS. 5, 6A and 6B with the blade holder angularly displaced by a second angle with respect to the position of FIG. 6A into a third angular position, the second angle being greater than the first angle of FIG. 6B.

Referring to FIGS. 6A, 6B and 6C, the left side housing member 36 of a blade housing 20 is shown with the blade holder 100 in a retracted position and two different cutting positions as defined by the depth adjuster 70. The depth adjuster 70 is selectively lockable into at least two locking positions 65, each locking position 65 corresponding to a different longitudinal position of the blade-holder bearing surface 74 along the chord AB. In FIG. 6A, the blade holder 100 is in a fully retracted position in which the cutting edge 305 of the blade 300 does not protrude from the housing 20. For reference purposes, a reference line A runs through the pivot axis $A_P$ and the forwardmost corner of the blade 300 adjacent the cutting edge 305 and denotes an initial angular position $\theta_i$ of the blade holder 100 with respect to the housing 20. An initial longitudinal position of the depth adjuster 70 corresponding to the initial angular position $\theta_i$ of the blade holder 100 is denoted by the line a. In the initial position of FIG. 6A, the blade-holder bearing surface 74 bears against the blade holder 100 to prevent the blade holder 100 from being angularly displaced by an amount that allows the protrusion of the cutting edge 305 to the outside of the housing 20.

The blade-holder bearing surface 74 is movable to different positions within the arcuate path of the blade holder 100 to variably obstruct angular displacement of the blade holder 100. For example, in FIG. 6B, a first locking position 65 allows the blade holder 100 to be displaced to a second angular position, represented by line B, by a first maximum angle $\theta_{M1}$ with respect to the fully retracted position before the blade holder 100 is arrested by the blade-holder bearing surface 74. The longitudinal position of the depth adjuster 70 corresponding to the second angular position B of the blade holder 100 is represented by the line b.

Referring to FIG. 6C, a second locking position 65 allows the blade holder 20 to be displaced by a second maximum angle $\theta_{M2}$ to a third angular position, represented by line C, before the blade holder 100 is arrested by the blade-holder bearing surface 74. The longitudinal position of the depth adjuster 70 corresponding to the second angular position C of the blade holder 100 is represented by the line c.

In the version of FIGS. 6A–6C, there are more than two locking positions 65, each corresponding to a different maximum angle $\theta_M$ of downward displacement of the blade holder 100. Furthermore, in this version, a more forward position of the blade holder bearing surface 74 corresponds to a lesser maximum angular displacement between the fully retracted and cutting positions of the blade holder 20 than does a more rearward position of the blade holder bearing surface 74. It will be appreciated that at least a portion of the arresting surface 160 of the blade holder extends along a line that is non-parallel with a line along which the blade-holder bearing surface 74 reciprocates as the depth adjuster 70 is reciprocated along the track 60. In the version of FIGS. 5 through 6C, the blade housing 20 includes a blade holder stop 80. An absolute maximum downward displacement for the blade holder 100 occurs when the blade holder 100 contacts the blade holder stop 80. In this particular case, the blade holder stop 80 is the rearwardmost boundary of the blade opening 42 and is positioned so as to contact the arresting surface 160 of the blade holder 100.

It is advantageous for one locking position 65 of the depth adjuster 70 to correspond to a "safety" position in which the blade holder 20 is prevented from pivoting to an extent that would cause the cutting edge 305 of the blade 300 retained thereby to protrude out of the housing 20 as, for example, in FIG. 6A. Alternatively, a separate locking member can be included, independent of the depth adjuster 70. Finally, as with other aspects and features of the cutting apparatus 10, alternative depth adjusters 70 of various configurations are within the scope and contemplation of the invention. The configurations introduced above, illustrated in the drawings and explained further below are illustrative, and not limiting, in nature.

Figure 4:
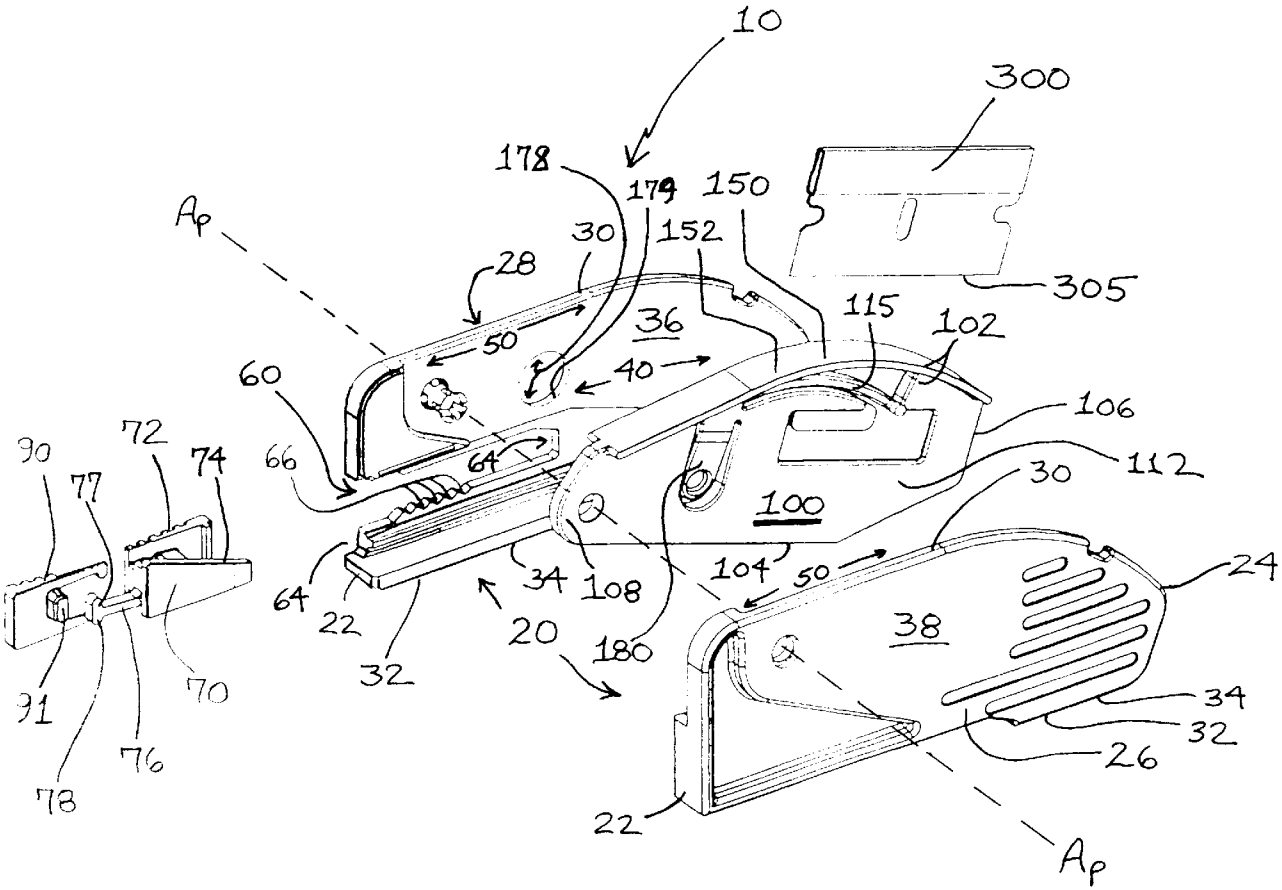
FIG. 4 is a right-rear exploded view of a cutting apparatus having a pivotable blade holder.

As shown most clearly in FIGS. 4, a depth adjuster 70 includes a button 72 accessible from the exterior of the housing 20 and a longitudinally extending, flexible arm 76 with a distal end 77. A lug 78 extends substantially perpendicularly from the arm 76 adjacent the distal end 77. The lug 78 is selectively engageable with each recess 66 of a set of lug-receiving recesses 66 that extend along the track 60. Each recess 66 corresponds to a longitudinal locking position 65 of the depth adjuster 70.

To lock the lug 78 into a recess 66, one version includes a slide lock 90 that cooperates with the depth adjuster 70 and is accessible to a user from the exterior of the housing 20. Referring to FIGS. 4, 5 and 6A, the slide lock 90 includes a laterally extending protrusion 91. As illustrated in FIG. 6A, the protrusion 91 of the slide lock 90 is movable with respect to the depth adjuster 70 between first and second longitudinal positions P1 and P2. In FIG. 6A, the protrusion 91 is actually shown in the first position P1, and shown in phantom in the second position P2. In the first position P1, the protrusion 91 bears against the arm 76, adjacent the distal end 77, to maintain the lug 78 within a recess 66. In the second position P2, the protrusion is displaced away from the distal end 77 so that the arm 76 can flex and allow the lug 78 to withdraw from a recess 66. Once the arm 76 can flex to allow the lug 78 to withdraw from the recesses 66, the user can urge the button 72 backward or forward to move the lug 78 between recesses 66. Once the lug 66 is aligned with a desired recess 66, the slide lock 90 can be moved so that the protrusion 91 moves toward the distal end 77 of the arm 76 to urge the lug 78 into the selected recess 66 and resists its withdrawal therefrom.

Figure 7:
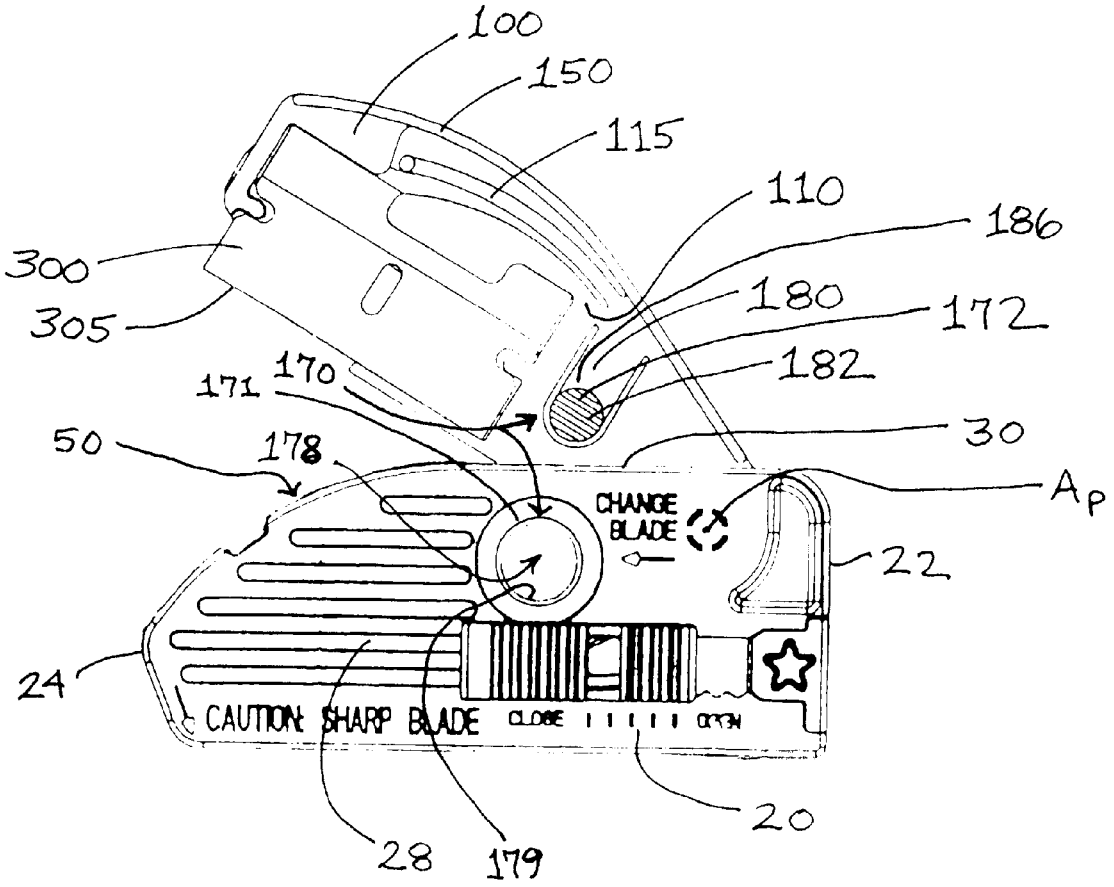
FIG. 7 is a left side view of a cutting apparatus with a pivotable blade holder angularly displaced into a blade-changing position.

In an embodiment in which the housing comprises separable left and right side housing members 36 and 38, changing of the blade 300 may be accomplished by separating the housing members 36 and 38, placing a new blade 300 into the blade holder 100 and rejoining the housing members 36 and 38. In an alternative embodiment, the blade 300 can be changed without disassembling the housing 20. Referring to FIG. 7, the upper surface 30 of the housing defines an actuator slot 50 that extends longitudinally forward of the pivot axis $A_P$ by a distance that is sufficient to allow the blade holder 100 to pivot upwardly and protrude out of the housing 20 through the actuator slot 50 and into a blade changing position. Furthermore, the relevant portion of the blade holder 100 is sufficiently narrow, and the actuator slot 50 sufficiently wide, to accommodate the upward pivotal travel of the blade holder 100 through the actuator slot 50.

In order to prevent the blade holder 100 from inadvertently pivoting upwardly into a blade changing position, one version includes a blade-changing lock 170 movable into locked and unlocked positions. The blade housing 20 includes a first lock element 171 adapted for selective locking engagement with a second lock element 172 on or within the blade holder 100. When the blade-changing lock 170 is in a locked position (i.e., when the first lock element 171 is in locking engagement with the second lock element 172), pivotal movement of the blade holder 100 with respect to the blade housing 20 is restricted between the fully retracted position and a cutting position. When the blade-changing lock 170 is in an unlocked position (i.e., when the first lock element 171 is out of locking engagement with the second lock element 172), the blade holder 100 can pivot upwardly to enable access to the blade 300 for changing or flipping to use the opposite end of the cutting edge 305.

Referring to FIGS. 1, 3, 4 and 7, one example of a blade-changing lock 170 is illustrated. One side of the housing 20—in this case the left side 28—includes a catch-engaging aperture 178 defined by an aperture boundary 179. The blade holder 100 includes a latch 180 having a catch 182. The catch 182 is moveable between a first, engaging position and a second, disengaged position. When the catch 182 is aligned with the catch-engaging aperture 178, it is normally biased into the first, engaging position by a resilient member 186 such that the catch 182 protrudes into the catch-engaging aperture 178 and arcuate movement of the catch 182 is limited to movement within the aperture boundary 179. During normal use, the catch 182 protrudes laterally into the catch-engaging aperture 178 where it is accessible to a user of the cutting apparatus 10 from outside the blade housing 20 through the catch-engaging aperture 178. The dimensions of the aperture boundary 179 are large enough with respect to the catch 182 to accommodate the movement of the catch 182 in an arcuate path centered at the pivot axis $A_P$ as the blade holder 100 is angularly displaced between a fully retracted and an extended cutting position. When it is desired to pivot the blade holder 100 into a blade-changing position, the catch 182 is displaced (e.g., "depressed") to the second, disengaged position in which the catch 182 can travel to the outside of the aperture boundary 179, thereby enabling the blade holder 100 to be pivoted upwardly to the blade-changing position. In the embodiment illustrated, the resilient member 186 normally biases the catch 182 laterally toward the first, aperture-engaging position. To change the blade 300, a user depresses the catch 182 with his or her finger, for example, until it is in the second, non-engaging position. The blade holder 100 can then be pivoted upwardly to the blade-changing position as the catch 182 passes through the blade cavity 40 and out the upper surface 30 through the actuator slot 50.

Alternative versions include blade-changing locks 170 of various configurations. In one alternative, the blade holder 100 includes a catch-engaging aperture 178 and the blade housing 20 includes a latch 180 with a catch 182 that is moveable into and out of engagement with the catch-engaging aperture 178. In alternative versions in which the blade holder 100 includes a catch-engaging aperture adapted for selective engagement with a catch 182 depending from the blade housing 20, the catch 182 can be a spring-loaded pin or threaded fastener, for example.

The foregoing is considered to be illustrative of the principles of the invention. Furthermore, since numerous modifications and changes will occur to those skilled in the art, it is not intended or desired that the foregoing limit the invention to the exact construction and operation shown and described. Accordingly, all suitable modifications and equivalents may be resorted to that appropriately fall within the scope of the invention as expressed in the appended claims.

What is claimed is:

1. A cutting apparatus comprising:

a blade housing having a forward end, a rear end, an internal blade cavity including a blade opening to the outside of the housing, and an upper surface including an actuator slot in communication with the internal blade cavity;

a blade holder adapted for removably retaining a cutting blade having a cutting edge, the blade holder being pivotally mounted within the housing for pivotal movement within the blade cavity about a pivot axis between a fully retracted position in which the cutting edge of a cutting blade retained by the blade holder does not protrude from within the blade cavity through the blade opening to the outside of the housing and a cutting position in which at least a portion of the cutting edge extends through the blade opening to the outside of the housing;

a biasing member that normally biases the blade holder toward the fully retracted position; and a blade actuator cooperating with the blade holder and extending upwardly through the actuator slot for access from outside the housing such that application of an external force on the blade actuator moves the blade holder toward a cutting position in opposition to the force provided by the biasing element.

2. The cutting apparatus of claim 1 wherein the blade housing further includes a lower surface defining a guiding surface along which the cutting apparatus is drawn over a material to be cut, the guiding surface including at least a portion of the blade opening, and wherein the cutting position is such that the cutting edge of the blade inclines rearwardly with respect to the guiding surface such that, when the cutting apparatus is drawn rearwardly with the guiding surface in contact with the material to be cut, the cutting edge advances through the material at an acute angle.

3. The cutting apparatus of claim 1 wherein the blade actuator depends from the blade holder and extends upwardly through the actuator slot.

4. The cutting apparatus of claim 1 wherein the blade actuator includes an upper side that extends at least partially forward of the pivot axis of the blade holder such that a downwardly directed force applied forward of the pivot axis to the upper side of the blade actuator urges the blade holder toward a cutting position.

5. The cutting apparatus of claim 4 wherein the blade housing further includes a lower surface defining a guiding surface along which the cutting apparatus is drawn over a material to be cut and wherein the cutting position is such that the cutting edge of the blade inclines rearwardly with respect to the guiding surface such that, when the cutting apparatus is drawn rearwardly with the guiding surface in contact with the material to be cut, the cutting edge advances through the material at an acute angle.

6. The cutting apparatus of claim 1 wherein the blade holder is pivotably displaceable from the fully retracted position along an arc of an imaginary circle and wherein the cutting apparatus further includes a depth adjuster selectively lockable into at least two locking positions, each locking position corresponding to a different maximum angle by which the blade holder can be displaced with respect to the fully retracted position.

7. The cutting apparatus of claim 6 wherein the blade housing further includes an elongated track extending along an imaginary chord of the imaginary circle and having fore and aft ends and wherein the depth adjuster is linearly reciprocable along the track, the depth adjuster including a button accessible to the user from the exterior of the housing and a blade-holder bearing surface movable in tandem with the button and extending laterally within the housing for selective arresting engagement with the blade holder.

8. The cutting apparatus of claim 7 wherein the blade holder includes an arresting surface extending forward of the pivot axis and adapted for alternative contacting engagement and disengagement with the blade-holder bearing surface and wherein the blade-holder bearing surface reciprocates along a linear path below the arresting surface and the arresting surface inclines rearwardly toward the pivot axis with respect to the reciprocation path of the blade-holder bearing surface such that more rearward positions of the blade-holder bearing surface correspond to greater maximum pivotal displacement angles of the blade holder than do more forward positions of the blade-holder bearing surface.

9. The cutting apparatus of claim 1 wherein the actuator slot in communication with the blade cavity is an elongated actuator slot sufficiently wide, and extending longitudinally forward of the pivot axis by a sufficient distance, to enable the blade holder to pivot upwardly and protrude out of the blade housing through the actuator slot into a blade changing position.

10. The cutting apparatus of claim 9 further including a blade-changing lock to prevent inadvertent pivoting of the blade holder into a blade changing position, the blade-changing lock including a first lock element carried by the blade housing and a second lock element carried by the blade holder, the first and second lock elements being selectively moveable into locked and unlocked positions with one another, the locked position being such that pivotal movement of the blade holder with respect to the blade housing is restricted between the fully retracted position and a cutting position and the unlocked position being such that the blade holder can pivot to a blade changing position.

11. A cutting apparatus comprising:

a blade housing having forward and rear ends, left and right sides, an upper surface, a lower surface defining a guiding surface along which the cutting apparatus can be drawn across a material to be cut and an internal blade cavity including a blade opening through the guiding surface to the outside of the housing, the upper surface including an actuator slot in communication with the blade cavity;

a blade holder adapted for removably retaining a cutting blade having a cutting edge, the blade holder being pivotally mounted within the housing for pivotal movement within the blade cavity about a lateral pivot axis between a fully retracted position in which the cutting edge of a cutting blade retained by the blade holder does not protrude through the blade opening to the outside of the housing and a cutting position in which at least a portion of the cutting edge extends through the blade opening to the outside of the housing, the cutting position being such that the cutting edge of the blade inclines rearwardly with respect to the guiding surface such that, when the cutting apparatus is drawn rearwardly with the guiding surface in contact with the material to be cut, the cutting edge advances through the material at an acute angle;

a biasing member that normally biases the blade holder toward the fully retracted position; and a blade actuator depending from the blade holder and extending upwardly through the actuator slot for access from outside the housing, the blade actuator including an upper side that extends at least partially forward of the pivot axis of the blade holder such that a downwardly directed force applied forward of the pivot axis to the upper side of the blade actuator urges the blade holder toward a cutting position.

12. The cutting apparatus of claim 11 further including a depth adjuster selectively lockable into at least two locking positions, each locking position corresponding to a different maximum angle by which the blade holder can be displaced with respect to the fully retracted position.

13. The cutting apparatus of claim 12 wherein the blade holder is pivotably displaceable from the fully retracted position along an arc of an imaginary circle, the blade housing further includes an elongated track extending along an imaginary chord of the imaginary circle and the depth adjuster is linearly reciprocable along the track, the depth adjuster including a button accessible to the user from the exterior of the housing and a blade-holder bearing surface movable in tandem with the button and extending laterally within the housing for selective arresting engagement with the blade holder.

14. The cutting apparatus of claim 13 wherein the blade holder includes an arresting surface extending forward of the pivot axis and adapted for alternative contacting engagement and disengagement with the blade-holder bearing surface and wherein the blade-holder bearing surface reciprocates along a linear path below the arresting surface and the arresting surface inclines rearwardly toward the pivot axis with respect to the reciprocation path of the blade-holder bearing surface such that more rearward positions of the blade-holder bearing surface correspond to greater maximum pivotal displacement angles of the blade holder than do more forward positions of the blade-holder bearing surface.

15. The cutting apparatus of claim 11 wherein the actuator slot in communication with the blade cavity is an elongated actuator slot sufficiently wide, and extending longitudinally forward of the pivot axis by a sufficient distance, to enable the blade holder to pivot upwardly and protrude out of the blade housing through the actuator slot into a blade changing position.

16. The cutting apparatus of claim 15 further including a blade-changing lock to prevent inadvertent pivoting of the blade holder into a blade changing position, the blade-changing lock including a first lock element carried by the blade housing and a second lock element carried by the blade holder, the first and second lock elements being selectively moveable into locked and unlocked positions with one another, the locked position being such that pivotal movement of the blade holder with respect to the blade housing is restricted between the fully retracted position and a cutting position and the unlocked position being such that the blade holder can pivot to a blade changing position.

* * * * *